United States Patent [19]

Smith

[11] 4,052,830

[45] Oct. 11, 1977

[54] CORNER FILLETS

[75] Inventor: Ken Smith, Leeds, England

[73] Assignee: John Barry Potter, Leeds, England

[21] Appl. No.: 687,412

[22] Filed: May 17, 1976

[30] Foreign Application Priority Data

May 17, 1975 United Kingdom ..... 21097/75

[51] Int. Cl.[2] ..... E04C 19/02

[52] U.S. Cl. ..... 52/288

[58] Field of Search ..... 52/288, 287, 631, 716–718, 52/71; 229/22, 41 R, 41 B, DIG. 1

[56] References Cited

U.S. PATENT DOCUMENTS 1,884,440 10/1932 Welch ..... 52/716

FOREIGN PATENT DOCUMENTS 905,798 9/1962 United Kingdom ..... 52/287

1,023,190 3/1966 United Kingdom ..... 52/288

*Primary Examiner*—John E. Murtagh

*Attorney, Agent, or Firm*—Fred Philpitt

[57] ABSTRACT

This invention relates to corner fillet by which is meant members which are adapted to lie across and occupy corners of for example rooms where a floor joins a wall or a skirting board attached to the wall, the corner fillet being used to screen or conceal the edge of the carpet laid on the floor, or to properly finish off the floor/wall joint so as to enhance its appearance.

A corner fillet according to the invention is also usable as a glazing strip in place of the conventional glazing systems using putty or beading.

Other uses of a corner fillet according to the invention will become apparent from the following description.

12 Claims, 6 Drawing Figures

FIG. 1
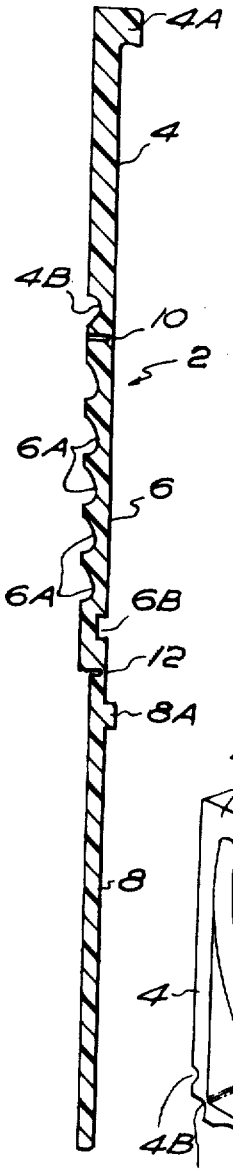
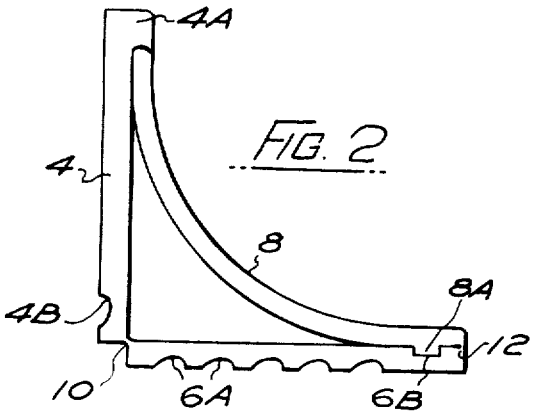
FIG. 2
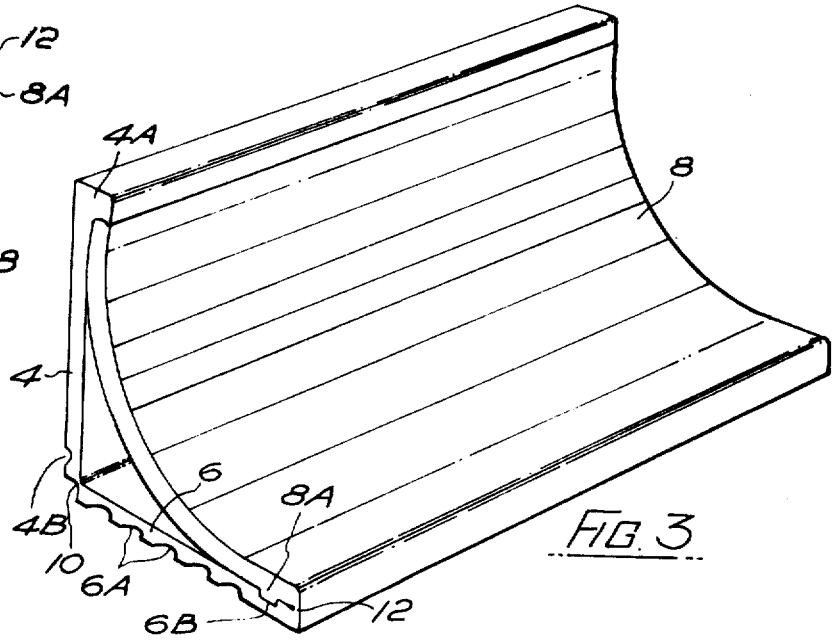
FIG. 3

CORNER FILLETS

According to the present invention, there is provided a corner fillet comprising a one-piece member which is capable of being hinged in at least two positions in its width, portions of the said member being adapted to fold about said hinge positions and to interengage so as to form the corner fillet.

Preferably, in its folded and interengaged position, the corner fillet is generally triangular in cross-section, one side of the triangular formation being concave.

In order that the invention be more readily understood, an embodiment thereof will now be described, by way of example, reference being made to the accompanyng drawings, wherein:

FIG. 1 is an end elevation of a member for forming a corner fillet according to the invention;

FIG. 2 is a side elevation of a corner fillet formed from the member of FIG. 1;

FIG. 3 is a perspective view of a length of corner fillet according to the invention;

Figure 4:
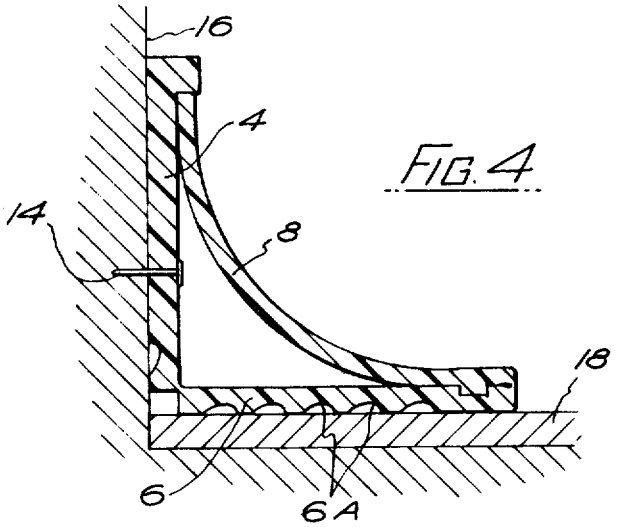
FIG. 4 shows the fillet of FIGS. 2 and 3 in use as a carpet holder.

Referring to the drawings, and firstly to FIG. 1, the member comprises an elongate member 2, which is preferably formed of a plastics material, such a polypropylene and which is formed by extrusion.

The member 2 comprises a first end portion 4 having an enlarged end portion 4A and a notch or recess 4B, a centre portion 6 having a series of notches or serrations 6A and a recesss 6B, and a second end portion 8 having a projection 8A which, as will be explained, is adapted to engage in the recess 6B of the centre portion 6. The portion 8 is of greater length than the portions 4 and 6 which themselves are substantially equal in length.

The portions 4, 6 and 8 are integrally formed, the portion 4 being connected to the portion 6 by a thin strip 10 of the material, and the portion 6 being connected to the portion 8 by a similar strip 12, the strips 10 and 12 acting as hinges when the member is folded to form a corner fillet according to the invention.

The member of FIG. 1 may be formed to any suitable dimension and length, and because of its relatively thin cross-section, it may be rolled for storage and transportation purposes.

Referring now to FIGS. 2 and 3, the member of FIG. 1 is shown in its form as a corner fillet according to the invention. As will be seen, the corner fillet comprises a vertical portion (first end portion 4), a horizontal portion (centre portion 6), and a curved portion (second end portion 8). The curved portion 8 is formed when the outer edge of the portion engages the underside of the enlarged portion 4A of the first portion 4 owing to the length of the second end portion 8 being greater than the straight line distance between the portion 4A and the strip 12. As will be seen when the corner fillet is formed, the projection 8A engages in the recess 6B.

FIG. 4 shows the corner fillet in use as a carpet or rug holder, the fillet being secured by nails or screws, one being indicated by reference numeral 14, to a wall 16, with the centre portion 6 of the fillet lying over the edge of a carpet of rug 18, the fillet being preferably fitted such that it slightly compresses the carpet or rug in its edge regions. Thus, the notches or serrations 6A may grip the carpet or rug 18 and prevent any undesirable movement thereof.

When, for example, decoration of the walls and/or ceiling of the room is to take place, the curved portion of the fillet is prised away from its engaged position so as to release the formation of the fillet, whereafter the curved portion may extend over the adjacent area of the carpet or rug 18. A cover sheet may then be laid over the carpet or rug and the second end portion 8 and centre portion 6 such that the carpet or rug is fully protected. Also, the top of the first portion 4 provides a guide to which painting may be carried out when the walls are being decorated.

In its use as described in relation to FIG. 4, the fillet may carry within its hollow interior electrical cables, central heating pipes and other services, or alternatively the fillet may be used solely for any of these purposes.

Figure 5:
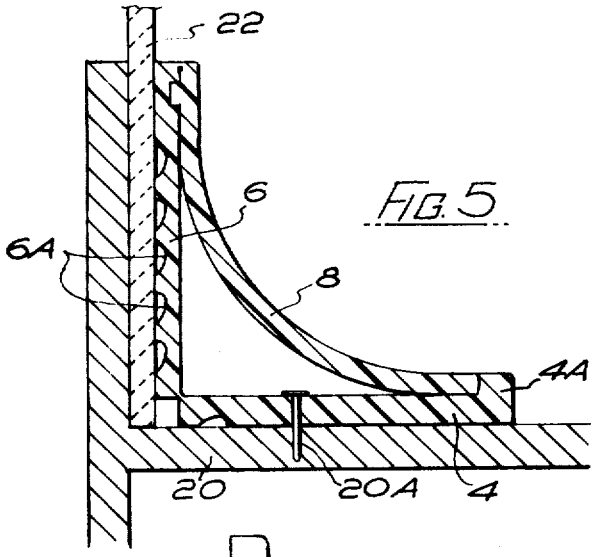
FIG. 5 shows the fillet of FIGS. 2 and 3 in use as a glazing strip.

Referring now to FIG. 5, part of a window frame 20 is shown carrying a panel of glass 22 held in position by a fillet according to the invention, the portion 4 being secured to the frame 20 by nails and screws, one of which is indicated by reference numberal 20A and the notches or serrations 6A being in engagement with the glass 22. If preferred, in its glazing application the notches or recesses 6A may be omitted from the fillet when it is extruded.

Figure 6:
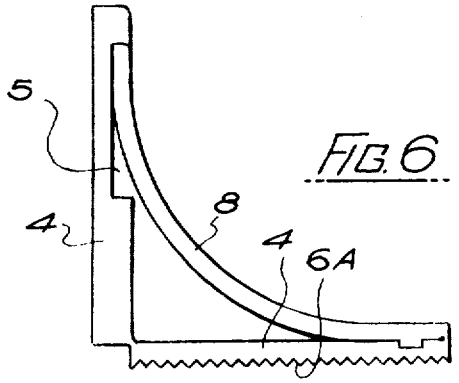
FIG. 6 shows an alternative form of the invention.

In the embodiments of FIG. 6, the portion 4 is provided with an inner recess 5 and the notches or serrations 6A are more pointed.

If desired, the concave member 50 when in position as shown in FIG. 7, may be supported internally of the corner fillet at pre-selected points so as to lessen the liability of inadvertant damage to the fillet.

It will be appreciated that the corner fillet according to the invention have uses other than those previously mentioned. The fillet may be used to screen joints between adjacent cupboard units, for example, and also as a cornice piece between walls and ceilings. Also, it will be apppreciated that services such as, for example, water, electricity supplies, etc., can be installed within the corner fillet so that such services are effectively hidden from view.

I claim:

1. A corner fillet composed of an elongated one-piece member that consists of a mid section and one end section on each side of the mid section, said end sections being joined to said mid section by two spaced apart hinge means that are parallel to each other and parallel to the longitudinal axis of said elongated one-piece member, said end sections being adapted to fold toward each other along said hinge lines so as to interengage along a line that is adjacent to the longitudinal outer side edges of said end sections to thereby form a corner fillet.

2. A corner fillet according to claim 1 wherein in its folded and interengaged position the corner fillet is of generally triangular configuration.

3. A corner fillet according to claim 2 wherein one end section of the triangular configuration has a concave disposition and is greater in width than either the other end section or said mid section.

4. A corner fillet according to claim 3, wherein oneof said end sections is disposed substantially at right angles to said mid section and the other end section tends to force said one end section and said mid section apart and into engagement with their respective adjacent surfaces.

5. A corner fillet according to claim 1, wherein said hinge means are formed by reducing the thickness of the one-piece member along longitudinal lines.

6. A corner fillet according to claim 1, wherein the corner fillet is composed of a synthetic plastics material.

7. A corner fillet according to claim 6 wherein the synthetic plastics material is polypropylene.

8. A corner fillet comprising an elongated one-piece member that consists of a mid section and one end section on each side of the mid section, said end sections being joined to said mid section by two spaced apart hinge means that are parallel to each other and parallel to the longitudinal axis of said elongated one-piece member, the first of said end sections and said mid section being disposed at approximately right angles to each other, the second of said end sections extending in a concave disposition between its line of hinge connection with said mid section and an elongated ridge extending along the outer edge of said first end section.

9. A corner fillet according to claim 8, wherein said mid section is provided with notches or serrations.

10. A corner fillet according to claim 8, wherein said hinge means are formed by reducing the thickness of the one-piece member along longitudinal lines.

11. A corner fillet according to claim 8, wherein the corner fillet is composed of a synthetic plastics material.

12. A corner fillet according to claim 11 wherein the synthetic plastics material is polypropylene.

* * * * *